US005802999A

United States Patent [19]

Papajewski et al.

[11] Patent Number: 5,802,999

[45] Date of Patent: Sep. 8, 1998

[54] STOP MECHANISM FOR A BUTTONHOLE SEWING MACHINE

[75] Inventors: Rudy Papajewski, deceased, late of Stutensee, by Edith Papajewski, legal representative; Gerd Papajewski, Stutensee, both of Germany

[73] Assignee: AMF Reece, Inc., Mechanicsville, Va.

[21] Appl. No.: 779,126

[22] Filed: Jan. 6, 1997

[51] Int. Cl.[6] ..... D05B 3/06; D05B 69/22

[52] U.S. Cl. ..... 112/67

[58] Field of Search ..... 112/67, 176, 271, 112/274, 220

[56] References Cited

U.S. PATENT DOCUMENTS

| | | | |
|---|---|---|---|
| 714,284 | 11/1902 | Dahl et al. . | |
| 1,669,912 | 5/1928 | Reece . | |
| 1,915,910 | 6/1933 | Allen et al. . | |
| 2,540,730 | 2/1951 | Hayes | 112/67 |
| 2,825,296 | 3/1958 | Sweet et al. . | |
| 2,889,793 | 6/1959 | Mueller et al. | 112/176 |
| 2,989,013 | 6/1961 | McGill et al. . | |
| 3,071,090 | 1/1963 | Zeier . | |
| 3,126,851 | 3/1964 | Carter . | |
| 3,499,404 | 3/1970 | Nicolay . | |
| 3,565,023 | 2/1971 | Lukins et al. . | |
| 3,693,564 | 9/1972 | Hsiao | 112/67 X |
| 3,804,038 | 4/1974 | Martin et al. . | |
| 3,894,500 | 7/1975 | Hsiao . | |
| 3,908,568 | 9/1975 | Fujii . | |
| 4,455,956 | 6/1984 | Yamamoto et al. . | |
| 4,658,743 | 4/1987 | Brauch et al. . | |
| 4,730,565 | 3/1988 | Iizuka . | |

FOREIGN PATENT DOCUMENTS

| | | | |
|---|---|---|---|
| 563267 | 2/1943 | United Kingdom | 112/67 |

*Primary Examiner*—Ismael Izaguirre
*Attorney, Agent, or Firm*—James Creighton Wray; Meera P. Narasimhan

[57] ABSTRACT

A stop cam is positioned on the main drive shaft of the buttonhole sewing machine. A stop lever moves axially between an engaged and a disengaged position. A heavy compression spring absorbs machine kinetic energy when the stop lever is in contact with the stop cam. A slide bar is positioned on one side of a lower end of the stop lever to hold the stop lever away from the stop cam. A spring positioned on the stop lever, opposite the slide bar, moves the stop lever into alignment with the stop cam. The tripping of a pedal moves the slide bar away from the stop lever thereby allowing the spring to move the stop lever into an engaged position. After substantial slowing, reaching the maximum displacement and spring loading, the cam presents a low flat surface to the stop lever. The spring pulls the lever against the flat and any remaining kinetic energy is too little for the cam to continue turning and raise the stop lever. The asymmetrical shape of the stop cam and the shape of the stop lever allows the sewing machine to come to rest in a predefined needle-up position. The stop bolt and spring housing are adjustable to provide exact stopping force and position.

16 Claims, 4 Drawing Sheets

STOP MECHANISM FOR A BUTTONHOLE SEWING MACHINE

BACKGROUND OF THE INVENTION

The present invention relates to a stop mechanism in a buttonhole sewing machine, which sews bight and bar stitches and cuts buttonholes in workpieces. Machines operate with parts such as a main drive shaft and an upper needle bar drive shaft rotating at high speeds. Kinetic energy must be absorbed to stop the machine. The main drive shaft must be stopped quickly and a needle must be stopped in a needle up position to allow the needle to be disengaged from the workpiece and thread to be cut. Once free, the workpiece can be moved to a new position and another buttonhole can be sewn and cut. Other models invariably have problems with the stop mechanism not allowing the full cycle through cutting and/or not absorbing enough energy to prevent overdriving and causing machine damage and wear. Older designs can result in flyover or double stops.

SUMMARY OF THE INVENTION

An objective of the present invention is to remedy the disadvantages of the prior art by providing a reliable apparatus that allows users to form buttonholes in garments and to quickly stop the machine in a needle up position at a precise home point of the cycle.

The stop mechanism stopping motion incorporates spring loading to dissipate energy and to achieve consistent stopping. Unlike other mechanisms which simply insert a bolt into a slot to stop the machine, the new spring loading system automatically compensates for higher or lower energy absorption to consistently bring the machine home every time. The new system is also far more forgiving of adjustments.

A strength of the present invention is that it provides a means for dependably stopping the main drive shaft of a buttonhole sewing machine quickly and in a precise position.

An industrial buttonhole sewing machine operates at very high speeds. A main drive shaft operates at speeds of up to or greater than 4000 rpm. To stop the drive shaft, kinetic energy must be absorbed quickly. In a last step of forming a buttonhole, power is released before the last turn, a knife drive is engaged, and then a stop mechanism is engaged.

In preferred embodiments, the stop mechanism remains disengaged and unloaded throughout the stitching and cutting cycles and operates in a last revolution when a cam allows a stop lever to move to an engaged position. Until needed, the stop mechanism remains in a disengaged position. In the disengaged position, an actuator bar controlled by a stop cam holds a stop lever in a first direction. A return spring urges the stop lever in an opposite direction. When the bar is released, the spring pushes the lever to engage a stopping cam which turns with the main shaft. The stopping cam lifts the stop lever against the force of a heavy spring. The lever pushes on the stop cam with the spring force causing the stop cam and the main drive shaft to slow and finally to stop and to come to rest, with the stop lever held against a flat surface of the stop cam and a needle in an up position.

In the preferred embodiment, cammed movement of the stop bar away from the stop lever or tripping of a stop pedal releases the stop lever. The stop lever is moved by the spring into the path of the stop cam on the main drive shaft. The stop cam moves the stop lever against the force of a loading spring, and finally the spring unloads and urges the stop lever against the flat surface of the stop cam fixed on the drive shaft stopping the drive shaft in the corresponding needle up position.

The loading of the stop spring also lifts a toggle so that the workpiece clamp springs up. The machine is ready for the operator to slide the workpiece to the next buttonhole position and depress the pedal toe to start the buttonhole.

These and further and other objects and features of the invention are apparent in the disclosure, which includes the above and ongoing written specification, with the claims and drawings.

DETAILED DESCRIPTION OF THE DRAWINGS

Figure 1:
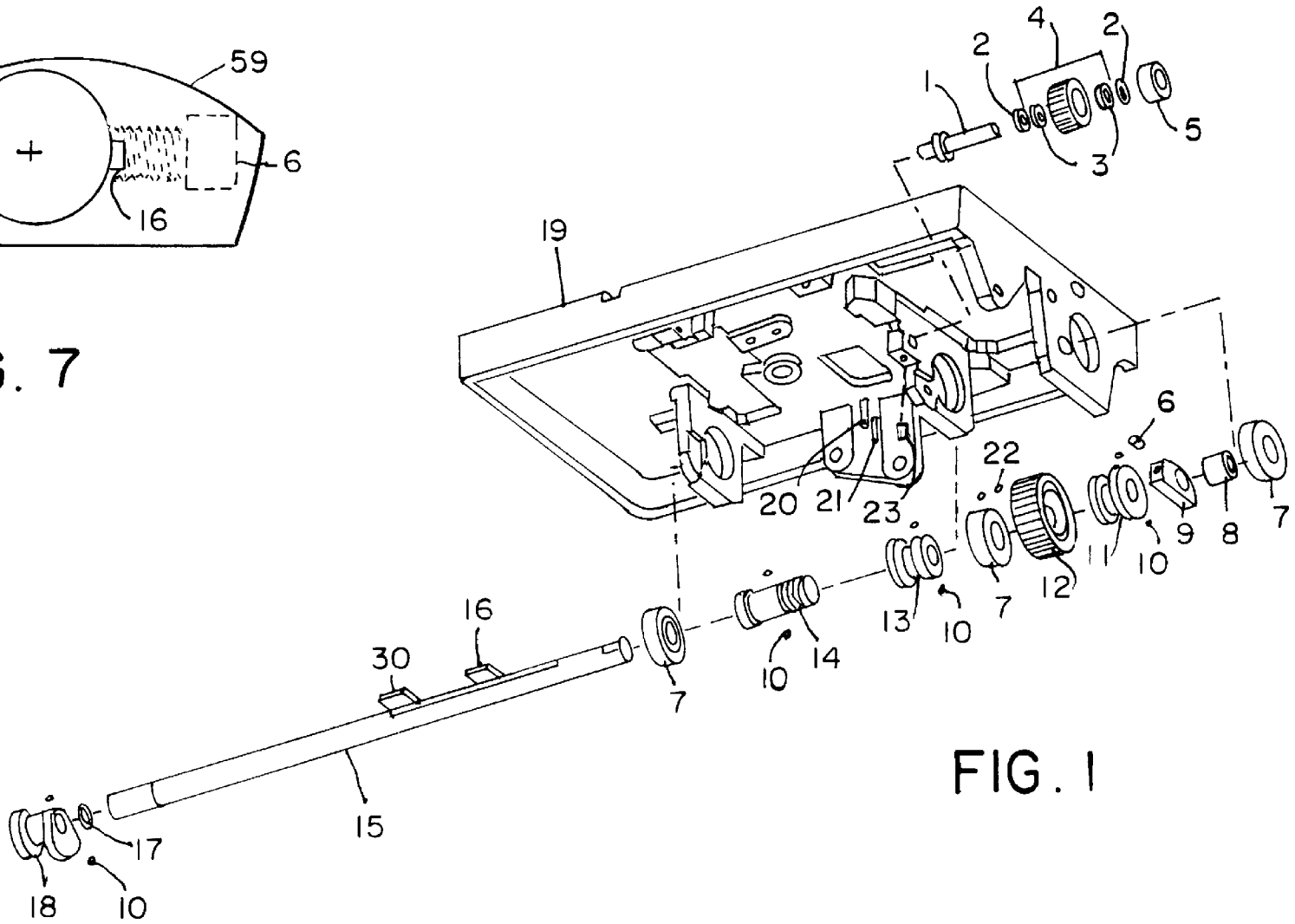
FIG. 1 is an exploded view of a stop cam on main drive shaft and mountings for the shaft.
Figure 3:
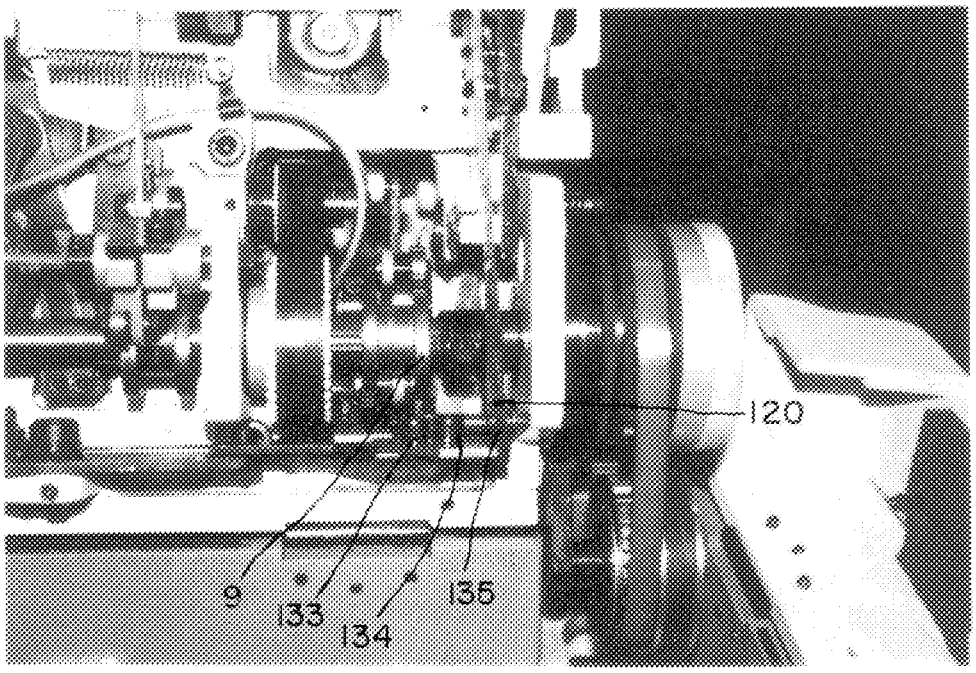
FIGS. 3 and 4 are perspective views of a stopping mechanism for a buttonhole sewing machine with the stop mechanism disengaged.
Figure 4:
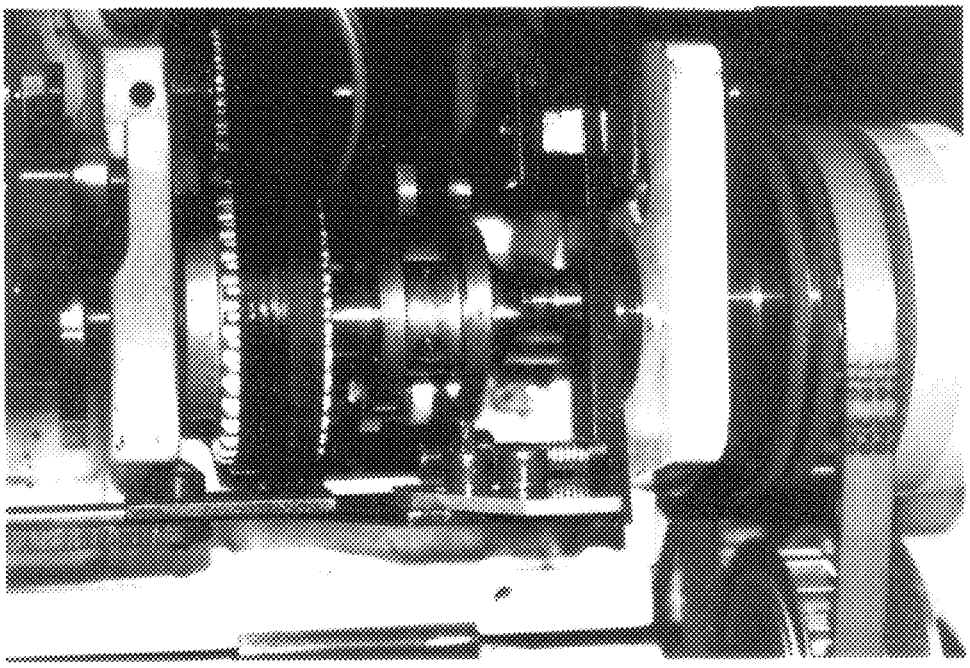
Figure 6:
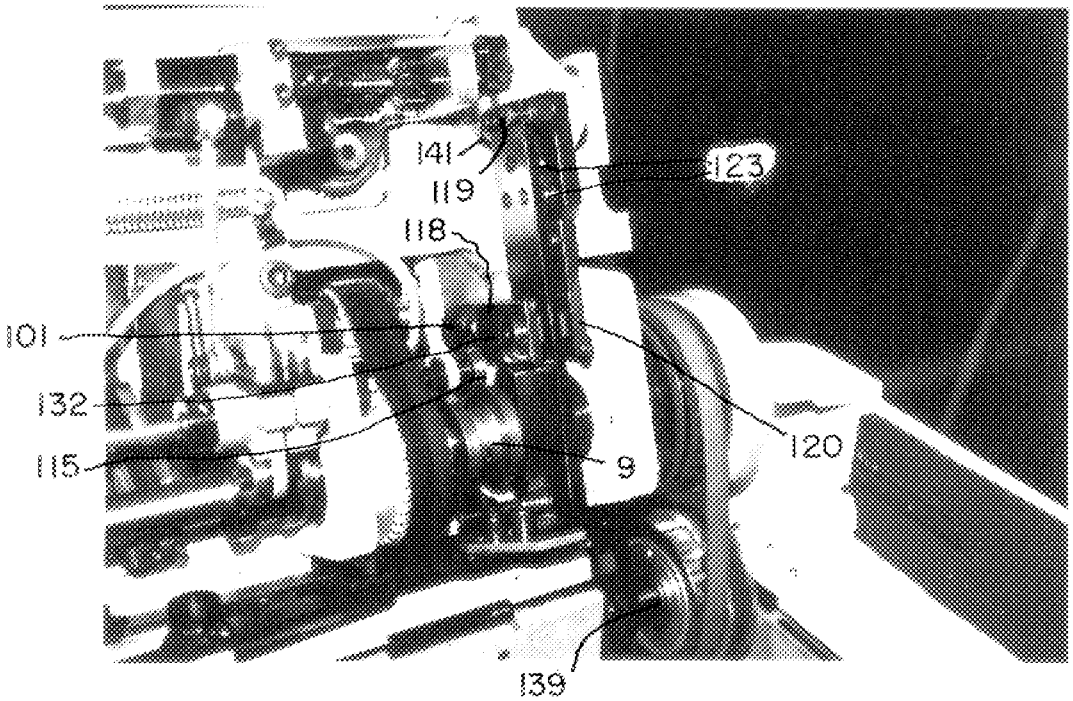
FIG. 6 is a view of the stop cam, the stop lever and the spring device in the stopped position.

Referring to FIG. 1, a stop cam 9 is positioned on the main drive shaft 15. The stop cam 9, as shown in FIG. 6, has a central hole through which the main drive shaft 15 extends. A stop lever 120, is shown in FIGS. 2, 3 and 4.

A bedplate 19 mounts an idler pulley eccentric shaft 1 with pulley washers 2. An idler pulley assembly 4 has pulley bearings 3 mounted on shaft 1. A collar 5 is clamped to the shaft 1. Main shaft bearings 7 mount the main shaft 15 in openings in lugs on the bed plate 19. A stop cam spacer 8 is mounted near one end of the main shaft 15. A stop cam 9 is keyed to the main shaft with a key 16. A set screw 6 holds the stop cam 9 in place. Next to stop cam 9 is a bight cam 11 held in position with set screws 10. An upper shaft drive pulley 12 is keyed to the main shaft 15 with key 30. On the opposite side of middle bearing 7 feed cam 13 is fixed on the main shaft 15 with set screws 10. A worm gear 14 is fixed on the main shaft 15 to drive a main sequencing cam. At the opposite end of the shaft a snap ring 17 axially positions a looper cam 18 on the main shaft 15.

To stop the machine, after a clutch is released, kinetic energy is absorbed and the entire drive is stopped by the stop cam 9 cooperating with a stop lever which loads a spring and engages a flat on the stop cam to stop all mechanisms in a home position.

Figure 2:
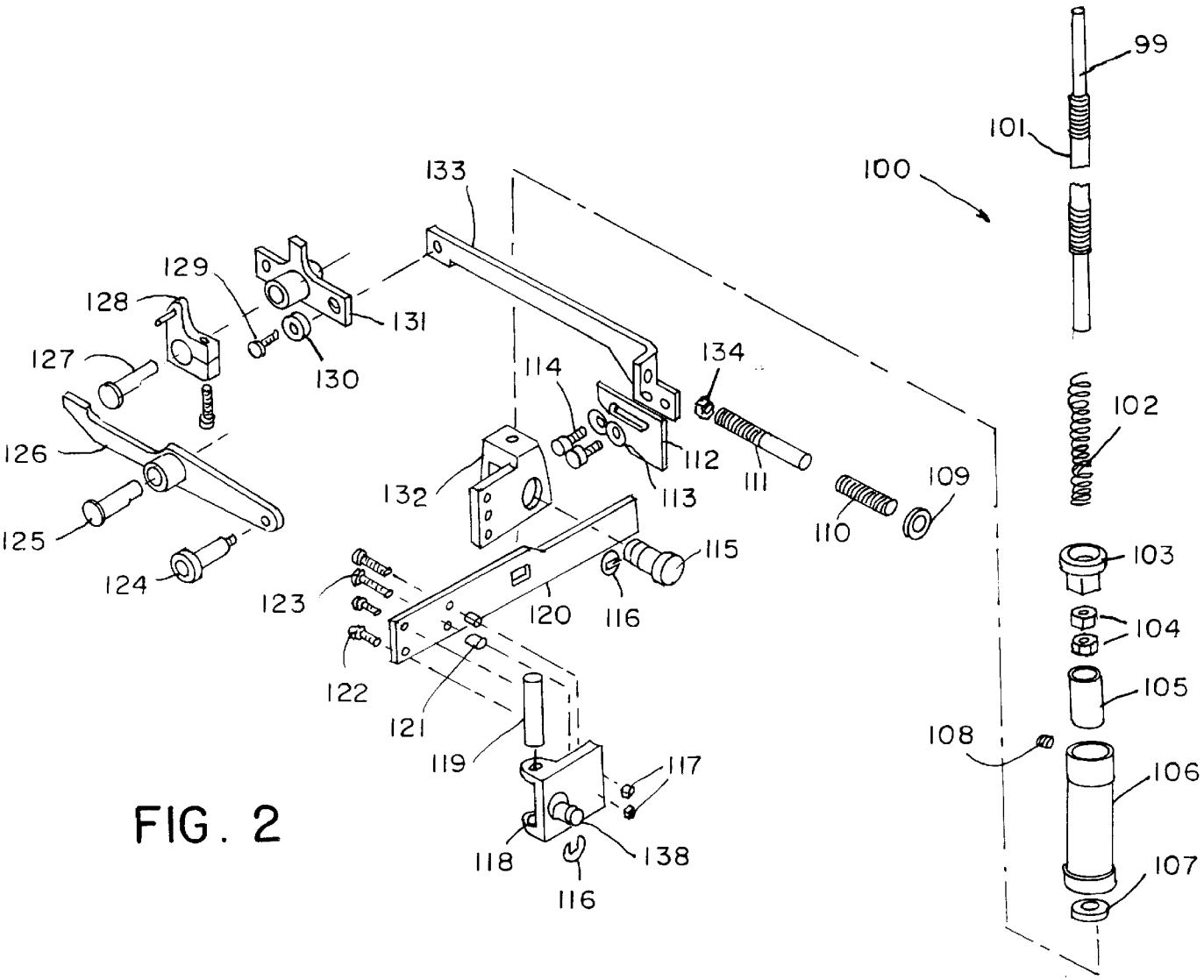
FIG. 2 is an exploded view of the stop lever and stop spring mechanism.

A preferred stop spring and stop lever assembly 100 is shown for clarity in a reversed and tilted view in FIG. 2. Stop bolt 101 extends through stop spring 102 and cylinder 106. The stop bolt 101 moves with stop lever 120 and compresses the compression stop spring 102. The free end 99 of stop bolt 101 may move through a fixed guide opening in the housing. Stop bolt nut 103 receives and abuts the spring 102. Locking nuts 104 hold the stop bolt nut 103 in a fixed position on the stop bolt 101. An unclamping adjusting screw 105 is threaded within unclamping cylinder 106. Set screws 108 engage flat faces on the adjusting screw 105 to control the exact compression force on spring 102 to bring the machine to a stop within less than one revolution after the stop lever 120 is aligned with the stop cam.

Stop bolt spacer spring 107 is positioned between cylinder 106 and stop lever clevis 132 which is attached by stop lever clevis pin 115 to a central opening in stop lever 120. E clip 116 locks the clevis pin 115 in place.

The stop lever 120 has upper mounting end holes which receive two bolts 122 which are secured in threaded openings on a flat side of stop lever pivot pin 119. Pin 119 is first placed in stop lever pivot mount 118, in which a pin 138 similar to pin 115 is fixed to pivot the mount 118, the pivot pin 119 and the stop lever 120 on the housing. Stop lever 120 has two degrees of freedom. Swinging on pivot 119 allows the stop lever 120 to move into and out of engagement with the stop cam. Turning on pin 138 allows the stop lever 120 to follow the stop cam and to load compression spring 102.

Return compression springs 121 are mounted on bolts 123 between stop lever 120 and stop lever mount 118 and are secured with nuts 117.

The return springs 121 urge the stop lever 120 into the stop cam engaging position. When power is removed and a slide bar 133 slides to allow the stop lever 120 to move toward the stop cam, the return springs 121 urge the stop lever 120 to the stop cam. As soon as one of the low cam points aligns with the stop lever 120, the stop lever 120 moves into engagement with the stop cam, for stopping the machine.

The slide bar or starter lever 133 has at its stop lever engaging end a lever plate 112. Plate 112 is adjustable with cap screws 114 and washers 113 mounted in vertical holes in the end of the slide bar 133. A stud 111 is secured in a threaded horizontal hole with lock nut 134. A light compression spring 110 surrounds stud 111, and a washer 109 abuts an opening in the housing through which stud 111 slides. The spring 110 urges the slide bar lever 133 away from engagement with the stop lever 120, and the stud 111 away from a clutch applying spring. The end of stud 111 engages the clutch applying spring.

An engaging lever 126 receives a pin 125 and a shoulder screw 124. Pin 127 is clamped in knock off adjusting lever 128 by a screw and extends through start/stop toggle arm 131. Screw 129 and shoulder nut 130 connect ends of toggle arm 131 and slide bar 133. Movement of toggle arm 131, by a main control cam or by lever 126 releases slide bar 133 to stop the machine by releasing the stop lever 120 with the starting lever plate 112.

In FIGS. 3 and 4, a slide 133 with a headed 134 adjusting screw 135 holds a stop lever 120 to the right, disengaged from stop cam 9.

Figure 5:
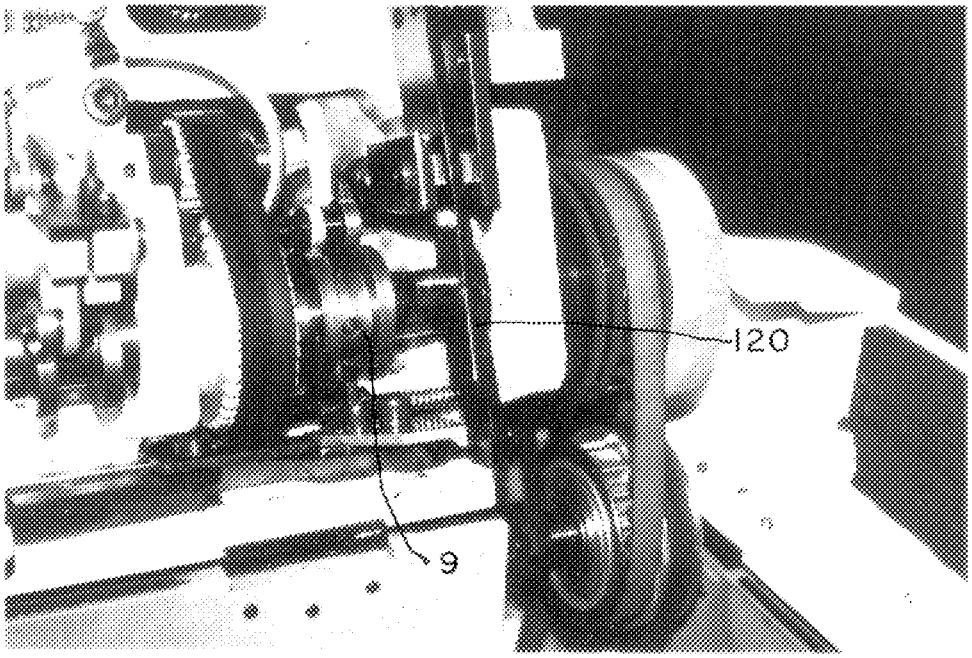
FIG. 5 is a perspective view of the stopping mechanism for a buttonhole sewing machine with the stop mechanism engaged showing the spring loaded.

To release the clutch, slide 133 moves to the left, allowing stop lever 120 to move to the left into engagement with stop cam 9. Kinetic energy keeps turning shaft 15 and operating the machine. The turning stop cam 9 lifts the stop lever 120 against spring force as shown in FIG. 5, changing the kinetic energy into potential energy (spring force). Finally, the machine stops when stop lever 120 engages the flat 139 of the stop cam 9 as shown in FIG. 6.

As shown in FIG. 6, the stop lever 120 is pivoted from a stub shaft 119 held on lugs 141 of a mount 118. Adjusting cap screws 123 hold springs which urge the stop lever 120 towards the cam-engaged stopping position.

FIGS. 2 and 6 show loading of a stop spring assembly. A clevis 132 and pin 115 connect the stop lever 120 to an adjusting bolt 101 and loading spring 102. A jam nut 104 holds the adjusted position.

The clevis loads spring 102 which extends through a cylinder 106. An adjusting screw sets the pre-loaded spring force, and jam nut 104 holds the adjustment. Set screws 108 hold an internal adjustment in the cylinder 106.

Figure 7:
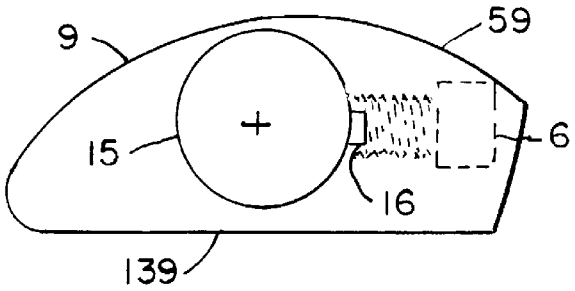
FIG. 7 is a left side elevation of the cam.

A preferred stop cam 9 is shown from the right side in FIG. 7. The stop cam 9 is mounted on the main shaft 15 with a key 16 and a set screw 6. The stop cam 9 rotates with the main shaft. When the slide bar releases the stop lever 120, the stop lever rides on the curved surface 59 of the stop cam 9 loading, partially unloading and releasing the spring assembly, absorbing the kinetic energy and slowing the main shaft 15 and the machine until the stop lever 120 snaps inward toward the main shaft 15 against flat 139 of the stop cam 9 under force of the spring, stopping the cam, the shafts and the entire mechanism in the home position.

In the stopped position, a clearance exists between the stop lever 120 and the stop cam 9. That clearance allows the slide to push the stop lever 120 to the right out of engagement with the stop cam 9 when the sewing operations start for the next buttonhole.

When the last stitch is made, the slide moves in a direction away from the return spring. That allows the return spring to move the stop lever 120 from a disengaged position, shown in FIG. 3, to an engaged position. The loading of the stop spring causes a clamp to spring up, for allowing an operator to slide a workpiece to a next buttonhole position. When the machine is ready to start again, the slide 133 pushes the stop lever 120 toward the return spring thereby compressing the return spring while moving the stop lever 120 into the disengaged position. The same movement of the slide bar engages the clutch.

In the start sequence, the operator steps on a small treadle which clamps the fabric, activates an air cylinder for sliding the slide bar to push the stop/start lever out of alignment with the stop cam and to engage the clutch. The machine continues through one complete buttonhole formation. When the last barring stitch is made, a cam dislodges a toggle allowing movement of the slide bar, which deactivates the clutch, and releases the stop bar. The knife cycles down and up to cut the buttonhole, absorbing some kinetic energy. Retraction of the slide bar releases the stop lever and allows the return spring to push the stop lever toward alignment with the stop cam. The stop bar moves onto the cam when a low surface of the cam is reached. As the curved stop cam face raises the lever, the lever compresses the spring, absorbing kinetic energy. At the same time, the knife moves up further absorbing energy. Finally, the cam begins to present the flat to the stop lever, and the compression spring pulls the lever against the flat of the stop cam, preventing further rotation of the stop cam and the shaft. At the same time, the clamp springs up, releasing the workpiece.

While the invention has been described with reference to specific embodiments, modifications and variations of the invention may be construed without departing from the scope of the invention, which is defined in the following claims.

We claim:

1. A stop apparatus for a buttonhole sewing machine comprising a housing, a main drive shaft in the housing, a stop cam on the main drive shaft, the stop cam having a curved surface and a flat, a stop lever pivoted from the housing and moveable between an engaged position and a disengaged position with respect to the cam, a slide bar connected to the housing for moving along the housing and against a lower end of the stop lever for moving the stop lever between the positions, a stop lever return spring connected to the stop lever for moving the stop lever between the disengaged position and the engaged position, wherein when the slide bar moves away from the stop lever, the spring pushes the stop lever to a changed position and when the slide bar moves toward the stop lever, energizes the spring, and moves the stop lever to a changed position, and a heavy energy-absorbing stop connected to the stop lever for urging the stop lever into contact with the curved surface of the stop cam as the stop cam turns and for urging the stop lever into contact with the flat to stop the cam and main shaft.

2. The apparatus of claim 1, wherein the slide bar pushes the stop lever to the disengaged position and the return spring urges the stop lever to the engaged position.

3. The apparatus of claim 1, wherein the return spring comprises a resilient flex in the stop lever.

4. The apparatus of claim 1, wherein the stop lever comprises support, loading and cam portions, wherein the cam portion abuts on the cam, wherein the support portion is mounted on a pin for permitting movement of the cam and loading portions and wherein the loading portion is connected to a stop spring for loading the stop spring and absorbing machine kinetic energy when the cam moves the lever and for holding the lever against a flat of the cam and stopping the cam and main drive shaft when the stop cam rotates to present the cam's flat to the stop lever.

5. The apparatus of claim 1, further comprising a stop bolt connected to the stop lever and a stop spring connected to the stop bolt, a cylinder partially surrounding the stop spring whereby lifting the stop lever with the stop cam pulls the stop bolt and compresses the stop spring against the cylinder.

6. The apparatus of claim 5, further comprising a stop lever clevis and pin connecting the stop lever to the stop bolt.

7. The apparatus of claim 1, wherein the stop cam has a flat on one side and the curved surface on the other side with an abrupt transition between a maximum throw of the curved surface and a surface of the flat.

8. The apparatus of claim 1, further comprising a stop lever pivot pin mounted at one end of the stop lever, a stop lever mount having spaced lugs for receiving the pivot pin and further comprising a mounting pin extending from the mount perpendicular to the pivot pin for mounting the mount and for allowing the mount to turn in the housing.

9. The apparatus of claim 8, wherein the return spring is mounted between the mount and the stop lever for urging the stop lever into engagement with the cam.

10. The apparatus of claim 9, wherein the return spring further comprises parallel helical cam precision springs mounted on parallel bolts extending between the mounts and the stop lever transverse to the pivot pin.

11. A method for stopping a buttonhole sewing machine comprising the steps of rotating a stop cam with a main drive shaft, holding a stop lever out of engagement with the stop cam, releasing the stop lever, urging the stop lever from a disengaged position to a stop cam engaged position, loading a heavy compression spring connected to the stop lever by moving the stop lever with a lobe on the stop cam while the stop lever is in the stop cam engaged position, maintaining the stop lever with the compression spring in contact with the stop cam, allowing the stop cam to come to rest abutting a flat on the stop cam, and stopping rotation of the stop cam by aligning the stop lever with the flat on the stop cam, and wherein the step of maintaining the stop lever further comprises the steps of controlling the position of the stop lever with a slide bar, releasing power to the main drive shaft, moving the slide bar away from the stop lever thereby allowing the spring to push the stop lever from the disengaged position to the engaged position, maintaining the engagement of the stop cam and the stop lever with the force of the large compression spring, wherein the stop cam has an asymmetrical shape and the shape of the stop cam allows the machine to stop in a precise position for allowing an operator to slide a workpiece to a next buttonhole position.

12. A stop apparatus for a buttonhole sewing machine comprising a housing, a main drive shaft in the housing, a stop cam on the main drive shaft, the stop cam having a curved surface and a flat, a stop lever pivoted from the housing and moveable between an engaged position and a disengaged position with respect to the cam, a stop bolt connected to the stop lever and a stop spring connected to the stop bolt, a cylinder partially surrounding the stop spring whereby lifting the stop lever with the stop cam pulls the stop bolt and compresses the stop spring against the cylinder, a slide bar connected to the housing for moving along the housing and against a lower end of the stop lever for moving the stop lever between the positions, a stop lever return spring connected to the stop lever for moving the stop lever between the disengaged position and the engaged position, wherein when the slide bar moves away from the stop lever, the spring pushes the stop lever to a changed position and when the slide bar moves toward the stop lever, energizes the spring, and moves the stop lever to a changed position, and a heavy energy-absorbing stop connected to the stop lever for urging the stop lever into contact with the curved surface of the stop cam as the stop cam turns and for urging the stop lever into contact with the flat to stop the cam and main shaft.

13. The apparatus of claim 12, further comprising a stop lever clevis and pin connecting the stop lever to the stop bolt.

14. A stop apparatus for a buttonhole sewing machine comprising a housing, a main drive shaft in the housing, a stop cam on the main drive shaft, the stop cam having a curved surface and a flat, a stop lever pivoted from the housing and moveable between an engaged position and a disengaged position with respect to the cam, a slide bar connected to the housing for moving along the housing and against a lower end of the stop lever for moving the stop lever between the positions, a stop lever return spring connected to the stop lever for moving the stop lever between the disengaged position and the engaged position, wherein when the slide bar moves away from the stop lever, the spring pushes the stop lever to a changed position and when the slide bar moves toward the stop lever, energizes the spring, and moves the stop lever to a changed position, and a heavy energy-absorbing stop connected to the stop lever for urging the stop lever into contact with the curved surface of the stop cam as the stop cam turns and for urging the stop lever into contact with the flat to stop the cam and main shaft, a stop lever pivot pin mounted at one end of the stop lever, a stop lever mount having spaced lugs for receiving the pivot pin and further comprising a mounting pin extending from the mount perpendicular to the pivot pin for mounting the mount and for allowing the mount to turn in the housing.

15. The apparatus of claim 14, wherein the return spring is mounted between the mount and the stop lever for urging the stop lever into engagement with the cam.

16. The apparatus of claim 15, wherein the return spring further comprises parallel helical cam precision springs mounted on parallel bolts extending between the mounts and the stop lever transverse to the pivot pin.

* * * * *